US010727015B2

(12) United States Patent
Wu

(10) Patent No.: US 10,727,015 B2
(45) Date of Patent: Jul. 28, 2020

(54) HIGH-VOLTAGE LARGE-CURRENT RELAY

(71) Applicant: SONG CHUAN PRECISION CO., LTD., New Taipei (TW)

(72) Inventor: Sung-Jen Wu, New Taipei (TW)

(73) Assignee: SONG CHUAN PRECISION CO., LTD., New Taipei (TW)

( * ) Notice: Subject to any disclaimer, the term of this patent is extended or adjusted under 35 U.S.C. 154(b) by 114 days.

(21) Appl. No.: 15/997,646

(22) Filed: Jun. 4, 2018

(65) Prior Publication Data

US 2019/0371553 A1 Dec. 5, 2019

(51) Int. Cl.

| | |
|---|---|
| ***H01H 50/56*** | (2006.01) |
| ***H01H 50/64*** | (2006.01) |
| ***H01H 33/08*** | (2006.01) |
| ***H01H 33/42*** | (2006.01) |
| ***H01H 9/34*** | (2006.01) |
| ***H01H 9/32*** | (2006.01) |
| *H01H 83/10* | (2006.01) |

(52) U.S. Cl.

CPC ..... *H01H 50/64* (2013.01); *H01H 9/32* (2013.01); *H01H 9/34* (2013.01); *H01H 33/08* (2013.01); *H01H 33/42* (2013.01); *H01H 50/56* (2013.01); *H01H 83/10* (2013.01); *H01H 2235/01* (2013.01)

(58) Field of Classification Search

CPC ..... H01H 50/56

See application file for complete search history.

(56) References Cited

U.S. PATENT DOCUMENTS

2015/0002248 A1* 1/2015 Iwamoto ..... H01H 3/001 335/192

2019/0013172 A1* 1/2019 Hayashida ..... H01H 1/50

* cited by examiner

*Primary Examiner* — Ramon M Barrera

(74) *Attorney, Agent, or Firm* — Fei-hung Yang

(57) ABSTRACT

A high-voltage large-current relay includes an electromagnet, at least one fixed transmission contact, at least one movable transmission contact, at least one fixed arc-striking contact, and at least one movable arc-striking contact. The fixed transmission contact and movable transmission contact are corresponsive to each other, and the fixed arc-striking contact and movable arc-striking contact are corresponsive to each other. The relay further includes at least one arc-striking spring plate and at least one transmission spring plate for installing the movable transmission contact and movable arc-striking contact respectively. The movable arc-striking contact is smaller than the movable transmission contact, and the arc-striking spring plate and the transmission spring plate are operated together. Before the electromagnetic effect of the electromagnet drives the movable transmission contact and fixed transmission contact into an open or closed state, the movable arc-striking contact and fixed arc-striking contact are contacted with each other.

18 Claims, 6 Drawing Sheets

HIGH-VOLTAGE LARGE-CURRENT RELAY

FIELD OF INVENTION

The present invention relates to the field of relays, in particular to a high-voltage large-current relay.

BACKGROUND OF INVENTION

1. Description of the Related Art

Relay is an electronic control device generally applied in an automatic control circuit for controlling a large current by a small current. When an electric arc is generated, electrical contacts may be melted, carbonized, deformed, or damaged, and the relay may be burned.

To prevent the situation of damaging the relay by the electric arc, related manufacturers generally provide an arc extinction structure installed in the relay to minimize the electric arc.

2. Summary of the Invention

Therefore, it is a primary objective of the present invention to provide a high-voltage large-current relay capable of stably striking and extinguishing the electric arc generated during the operation of the relay to prevent a load circuit connected to the relay from being burned, damaged or even exploded and also to extend the service life of the relay effectively.

To achieve the aforementioned and other objectives, the present invention provides a high-voltage large-current relay comprising an electromagnet, at least one fixed transmission contact, at least one movable transmission contact, at least one fixed arc-striking contact, and at least one movable arc-striking contact, and the fixed transmission contact and the movable transmission contact being configured to be corresponsive to each other, and the fixed arc-striking contact and the movable arc-striking contact being configured to be corresponsive to each other, characterized in that the relay further comprises at least one arc-striking spring plate and at least one transmission spring plate, and the movable transmission contact is disposed on the transmission spring plate, and the movable arc-striking contact is disposed on the arc-striking spring plate; wherein the movable arc-striking contact is smaller than the movable transmission contact, and the arc-striking spring plate and the transmission spring plate are operated together, and the movable arc-striking contact and the fixed arc-striking contact are in a mutually contacted state before the movable transmission contact and the fixed transmission contact are driven into an open or closed state by the electromagnetic effect of the electromagnet.

With the design of the movable arc-striking contact being smaller than the movable transmission contact, a gap used for arc extinction is provided as much as possible in the existing space of the relay in order to extinguish the electric arc generated during the operation of the relay. Meanwhile, the volume of the relay is reduced to lower the production cost.

DESCRIPTION OF THE PREFERRED EMBODIMENTS

Figure 1A:
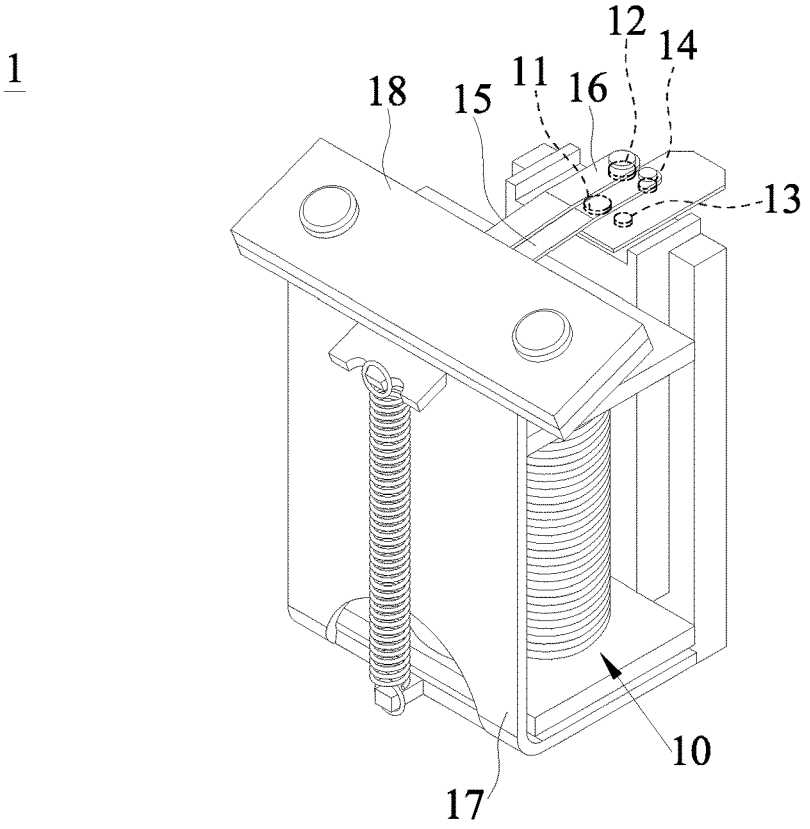
FIG. 1A is a perspective view of a first embodiment of the present invention.
Figure 1B:
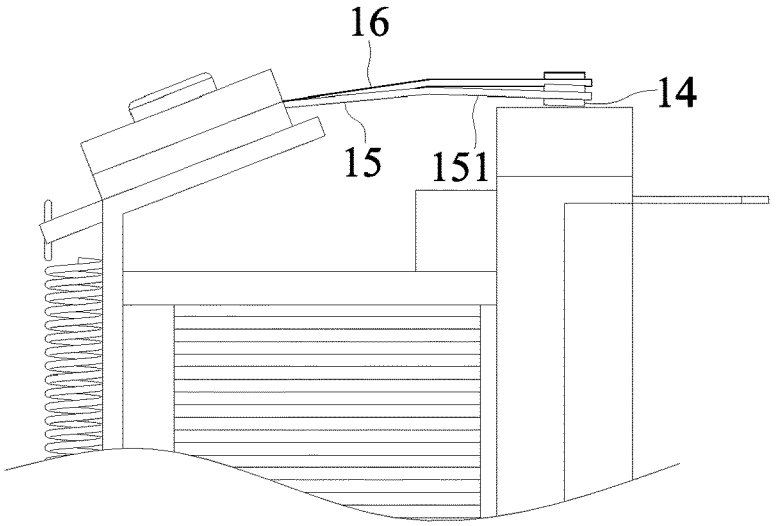
FIG. 1B is a side view of a first embodiment of the present invention.

To make it easier for our examiner to understand the objective, technical characteristics, structure, innovative features, and performance of the invention, we use preferred embodiments together with the attached drawings for the detailed description of the invention.

With reference to FIGS. 1A~1B and 2A~2B for a schematic view, a side view and schematic views of the applications of a high-voltage large-current relay in accordance with the first embodiment of the present invention respectively, the high-voltage large-current relay 1 comprises an electromagnet 10, at least one fixed transmission contact 11 and at least one movable transmission contact 12 configured to be corresponsive to each other, and at least one fixed arc-striking contact 13 and at least one movable arc-striking contact 14 configured to be corresponsive to each other.

The relay 1 further comprises at least one arc-striking spring plate 15 and a transmission spring plate 16, and the movable transmission contact 12 is disposed on the transmission spring plate 16, and the movable arc-striking contact 14 is disposed on the arc-striking spring plate 15. Wherein, the movable arc-striking contact 14 is smaller than the movable transmission contact 12, and the arc-striking spring plate 15 and the transmission spring plate 16 are operated together. Before the movable transmission contact 12 and the fixed transmission contact 11 are driven into an open or closed state by the electromagnetic effect of the electromagnet, the movable arc-striking contact 14 and the fixed arc-striking contact 13 are in a mutually contacted state. By the size limitation of the movable arc-striking contact 14 being smaller than the movable transmission contact 12, and before the movable transmission contact 12 and the fixed transmission contact are driven into the open or closed state, the movable arc-striking contact 14 and the fixed arc-striking contact 13 are in the mutually contacted state, the arc extinction performance can be improved, so that the relay can withstand and extinguish the extremely high power electric arc during an operation of large current and high voltage, so as to prevent the electric arc from damaging the relay 1 during the operation of the relay 1 and extend the service life of the relay 1 effectively.

Compared with the prior art, the relay 1 of the present invention limits the movable arc-striking contact 14 to be smaller than the movable transmission contact 12 and provides a structure with as much space as possible in the limited space for the arc extinction and with a better and more stable arc extinction effect. Since the electric arc mainly occurs between the movable arc-striking contact 14 and the fixed arc-striking contact 13, and the space sufficient for extinguishing the electric arc depends on the spacing between the movable arc-striking contact 14 and the movable transmission contact 12. To prevent the continual existence of the electric arc generated during an operation or affecting the adjacent contacts to result in a low electric arc extinction performance, conventional relays intuitively adopt the design of increasing the spacing between the movable arc-striking contact 14 and the movable transmission contact 12 to improve the electric arc extinction performance. In other words, the distance between the movable arc-striking contact 14 and the movable transmission contact 12 is increased. However, such arrangement requires a larger space of the relay and thus increases the volume of the relay. Particularly, a very large space must be reserved for the installation of the aforementioned arc extinction structure if the relay needs to control a plurality of load circuits. Therefore, the volume of the relay must be increased further. These are the drawbacks of the past and present relays installed with the arc extinction structure failing to overcome, and the relay cannot have a high arc extinction performance and the volume of the relay cannot be reduced effectively. The relay 1 of the present invention is characterized in that the movable arc-striking contact 14 is smaller than the movable transmission contact 12, so that it is not necessary to occupy too much space or increase the distance between the movable arc-striking contact 14 and the movable transmission contact 12 to provide a better and more stable arc extinction performance in the limited space of relay 1, so as to cope with the compact requirement of the relay 1. The present invention reduces the volume of the relay 1 effectively and lowers the cost significantly.

Further, the relay 1 has a base 17 and an armature assembly 18, and the base 17 is provided for installing the armature assembly 18 and the aforementioned components, and the electromagnet 10 comes with a coil structure and produces a magnetic force by an electromagnetic effect after the electrical conduction, and the arc-striking spring plate 15 and the transmission spring plate 16 are driven by the armature assembly 18 to move respect to the fixed arc-striking contact 13 and the fixed transmission contact 11. To extend the service life of the movable arc-striking contact 14 and the fixed arc-striking contact 13, these contacts may be made of a material such as silver or tungsten with a high melting point and a better energy withstanding strength. To provide a better electrically conductive effect of the movable transmission contact 12 and the fixed transmission contact 11, these contacts may be made of a material such as silver and tungsten.

In this embodiment, the arc-striking spring plate 15 has a width smaller than the transmission spring plate 16 and provides a better arc-striking effect. The extinction of the electric arc is achieved by designing the movable arc-striking contact 14 to be smaller than the movable transmission contact 12, and the movable arc-striking contact 14 and the fixed arc-striking contact 13 are contacted with each other to define the open or closed state of the movable transmission contact 12 and the fixed transmission contact 11, so as to protect the relay 1 from accidents such as explosions. The design of the arc-striking spring plate 15 having a width smaller than the transmission spring plate 16 further increases the distance between the arc-striking spring plate 15 and the transmission spring plate 16 (in other words, the arc gap for the arc extinction is increased). After the electric arc is generated, the design of the arc-striking spring plate 15 having a width smaller than the transmission spring plate 16 and providing a gap for the arc extinction to minimize damages caused by the electric arc further prevents the electric arc from staying too long or extending to the transmission spring plate 16. In addition, the present invention can save the installation space.

In addition, the arc-striking spring plate 15 and the transmission spring plate 16 are configured to be adjacent and transversely parallel to each other such as the arrangement of piano keys, and the tops and bottoms of the fixed arc-striking contact 13 and the fixed transmission contact 11 are contacted closely, so that several arc-striking spring plates 15 and transmission spring plates 16 can be added along a single direction to save the installation space effectively. In this embodiment, the arc-striking spring plate 15 has an inclined portion 151, and the movable arc-striking contact 14 is disposed in the inclined portion 151, and the inclined portion 151 is tilted in a direction towards the fixed arc-striking contact 13 to facilitate the movable arc-striking contact 14 and the fixed arc-striking contact 13 to contact with each other before the movable transmission contact 12 and the fixed transmission contact 11 are set to the open or closed state. In addition, the movable arc-striking contact 14 may be designed with a thickness greater than the movable transmission contact 12 to achieve the aforementioned effects.

Figure 2A:
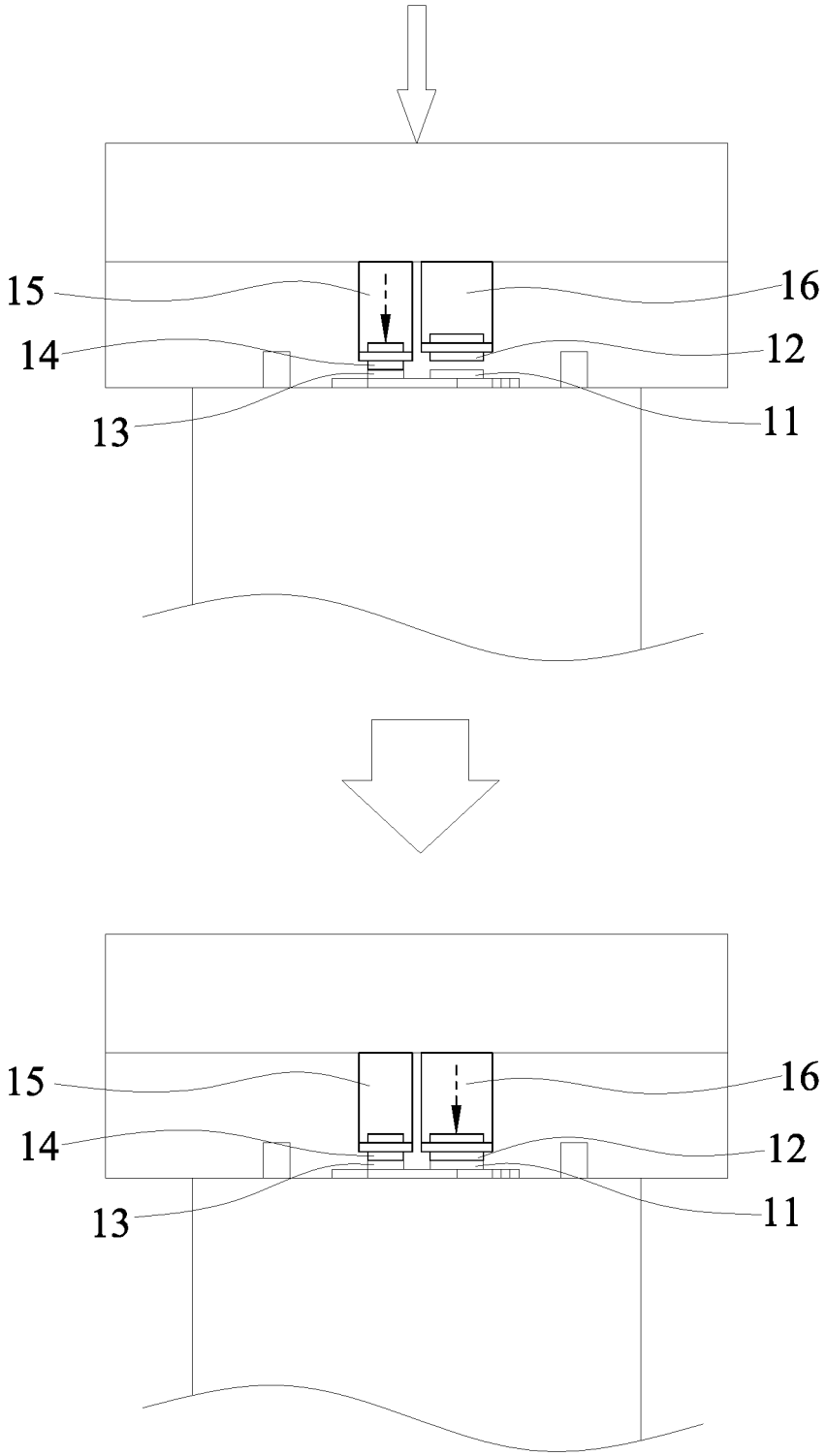
FIG. 2A is a schematic view showing a first application of a first embodiment of the present invention.
Figure 2B:
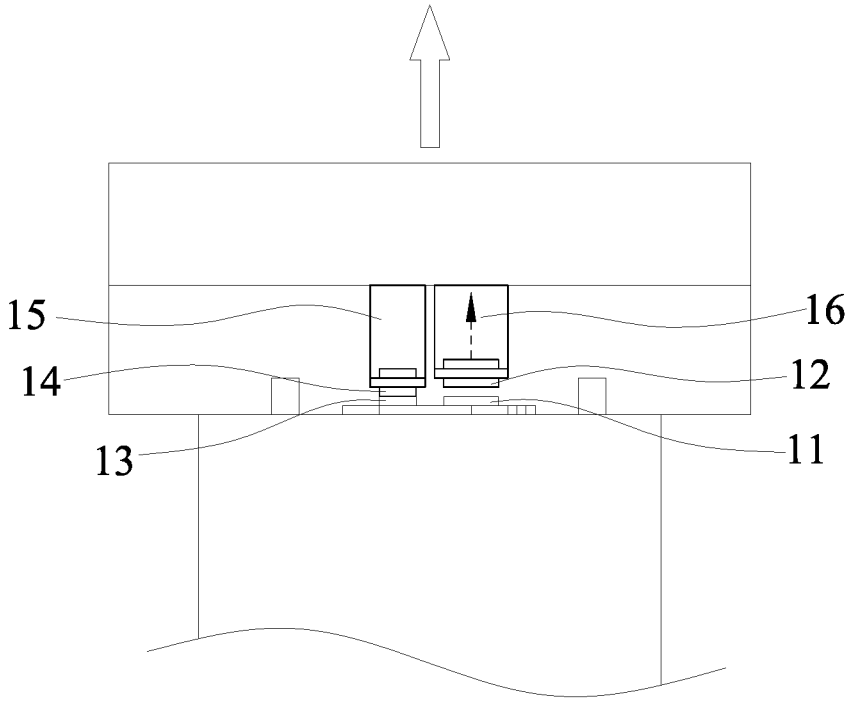
FIG. 2B is a schematic view showing a second application of a first embodiment of the present invention.
Figure 3:
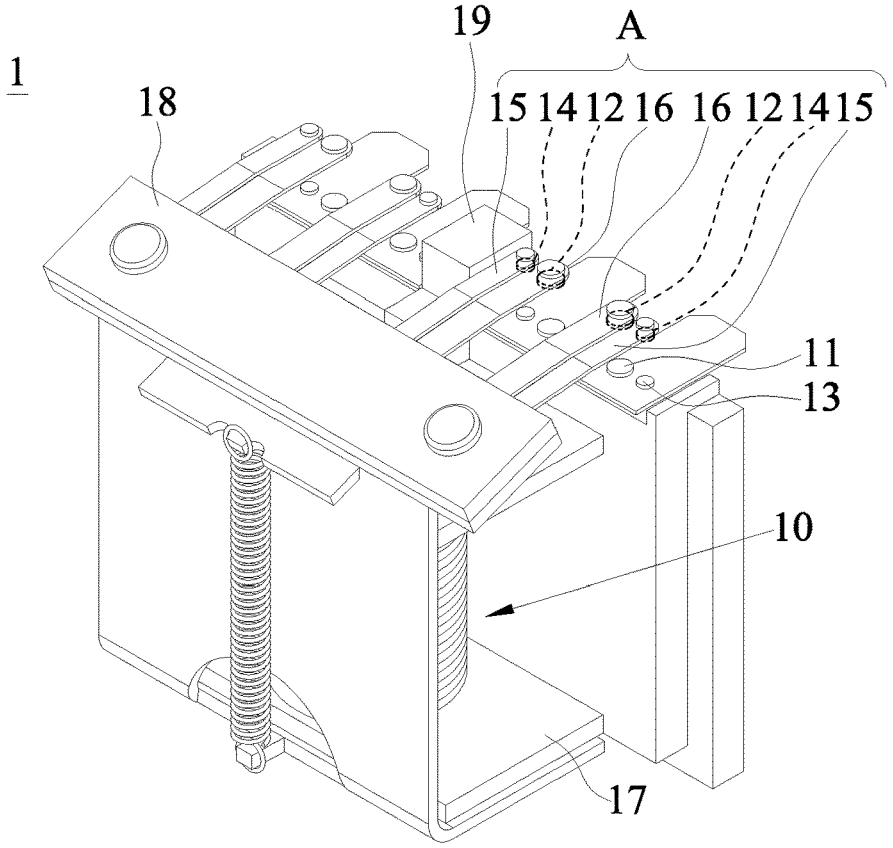
FIG. 3 is a perspective view of a second embodiment of the present invention.
Figure 4:
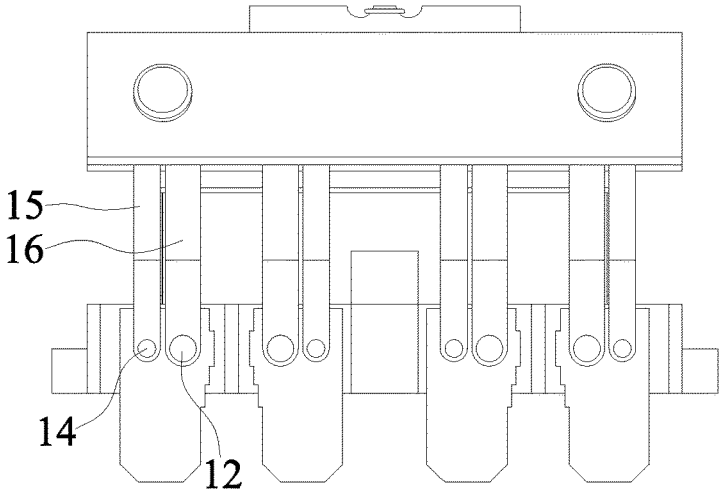
FIG. 4 is a schematic planar view of the second embodiment of the present invention.

With reference to FIGS. 2A and 2B for an application, the electromagnet 10 produces a magnetic force by the electromagnetic effect after an electrical conduction, so that the armature assembly 18 is attracted to drive the arc-striking spring plate 15 and the transmission spring plate 16 to move towards the fixed arc-striking contact 13 and the fixed transmission contact 11 respectively. Now, before the movable transmission contact 12 and the fixed transmission contact 11 are set to the mutually closed state, the movable arc-striking contact 14 and the fixed arc-striking contact 13 are in contact with each other to define an electrical conduction state, and the gap of the structure with the movable arc-striking contact 14 being smaller than the movable transmission contact 12 can effectively extinguish the electric arc instantly generated by the conduction of the circuit. After the movable transmission contact 12 and the fixed transmission contact 11 are set to the closed state, a stable electrical path is formed. When the magnetic force of the electromagnetic structure disappears, the armature assembly 18 loses its attraction by the magnetic force, so that the movable transmission contact 12 is disconnected from the fixed transmission contact 11. Before the movable transmission contact 12 and the fixed transmission contact 11 are disconnected, the movable arc-striking contact 14 and the fixed arc-striking contact 13 are situated in a contacted state, and at the moment when the movable transmission contact 12 is being disconnected from the fixed transmission contact 11, the movable arc-striking contact 14 and the fixed arc-striking contact 13 are still situated at the contacted state to maintain the electrical conduction status. Therefore, when the movable transmission contact 12 and the fixed transmission contact 11 are disconnected, no electric arc will be generated. The electric arc generated when the movable arc-striking contact 14 is disconnected from the fixed arc-striking contact 13 can be extinguished by the gap from the movable arc-striking contact 14 which is smaller than that from the movable transmission contact 12. Therefore, the relay 1 of the present invention can effectively prevent the movable transmission contact 12 and the fixed transmission contact 11 from being burned or damaged by the energy of the electric arc or even prevent accidents such as even an explosion of the relay 1.

With reference to FIGS. 3, 4 and 5A-5B for a perspective view, a planar view and schematic views of a high-voltage large-current relay in accordance with the second embodiment of the present invention respectively, the content and technical characteristics same as those of the first embodiment will not be repeated, and the components of this embodiment same as those of the first embodiment will be represented by the same respective numerals. In this embodiment, if the arc-striking spring plate 15 and the transmission spring plate 16 come with a plural quantity, the transmission spring plates 16 are clamped between two of the arc-striking spring plates 15, and the arc-striking spring plates 15 and the transmission spring plates 16 are configured to be transversely parallel to one another. Before the relay 1 is operated to magnetically attract and drive the movable transmission contact 12 and the fixed transmission contact 11 into an open or closed state, the movable arc-striking contact 14 and the fixed arc-striking contact 13 are situated at a mutually contacted state. Since the transmission spring plates 16 are clamped between the arc-striking spring plates 15, and the structure of the movable arc-striking contacts being smaller than the movable transmission contact 12 provides a gap capable of effectively extinguish the electric arc. For example, after an electric arc or spark is generated, even the electric arc moving towards the movable transmission contacts 12 and the fixed transmission contacts 11 can be extinguished by the gap to prevent short circuits or explosions. Therefore, the aforementioned clamping configuration naturally provides an anti-explosion arc-extinction protection and further implements the arc-striking and arc extinction operation.

Further, the structure of this arrangement may install a magnetic device (such as a permanent magnet (not shown in the figure) in the relay 1 and at a position corresponsive to the movable arc-striking contacts 14 and the fixed arc-striking contacts 13. The magnet force of the magnetic device affects the electric arc generated by the movable arc-striking contacts 14 and the fixed arc-striking contacts 13 to quickly strike the electric arc until the electric arc is extinguished. Particularly, in an application of high voltage, the additional installation of the magnetic device can definitely extinguish the electric arc.

Preferably, the transmission spring plates 16 clamped between two the arc-striking spring plate 15 are of the same conductive loop to form a switch set A in order to meet different requirements. In the relay 1, several switch sets A, each comprising the arc-striking spring plate 15 and the transmission spring plate 16 may be installed along a single direction as needed to achieve an excellent arc extinction performance. When the relay 1 has the switch set A comprising the arc-striking spring plate 15 and the transmission spring plate 16, the relay 1 further has at least one spacer 19 installed between any two adjacent switch sets A for resisting the interference when the arc-striking spring plate 15 and the transmission spring plate 16 of two different switch sets are electrically conducted. Preferably, the spacer 19 is integrally formed in the base 17. In this embodiment, the relay 1 has two switch sets A and one spacer 19.

In addition, the spacing between the transmission spring plates 16 clamped between two arc-striking spring plates 15 is greater than the spacing between the adjacent arc-striking spring plate 15 and transmission spring plate 16, so as to further increase the spacing between two transmission spring plates 16 and prevent the interference produced by the transmission spring plates 16 used for current transmission during the electrical conduction. Since the movable arc-striking contact 14 is smaller than the movable transmission contact 12, and the arc-striking spring plate 15 has a width smaller than the transmission spring plate 16, the volume of the relay 1 will not be increased even if the aforementioned spacing between the transmission spring plates 16 is increased. Therefore, the relay 1 of this invention can meet the market requirement for miniaturization.

Figure 5A:
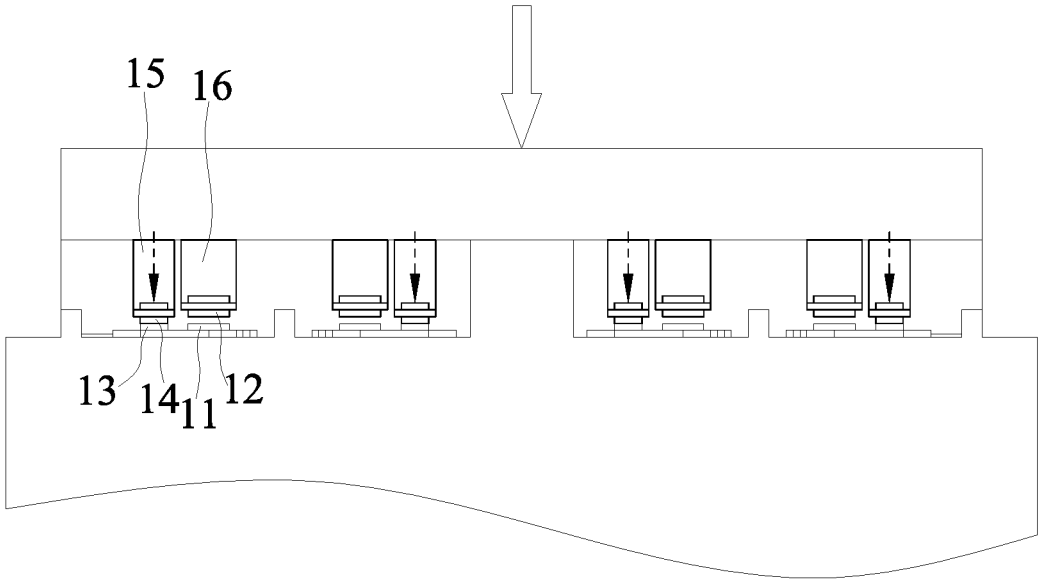
FIG. 5A is a schematic view showing a first application of the second embodiment of the present invention.
Figure 5B:
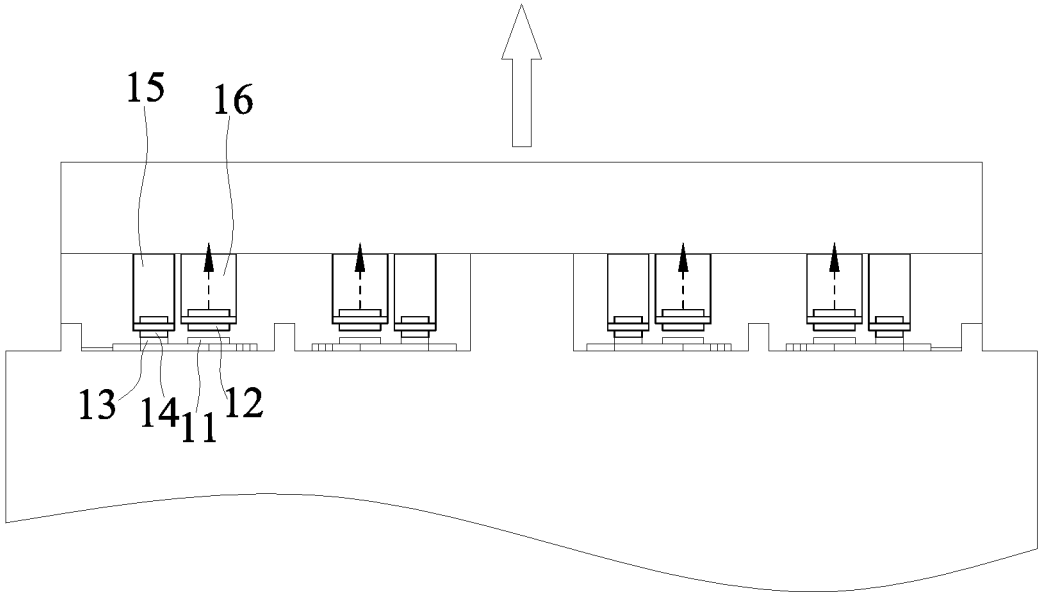
FIG. 5B is a schematic view showing a second application of the second embodiment of the present invention.

With reference to FIGS. 5A-5B for an application of the relay, the electromagnet 10 produces a magnetic force to attract the armature assembly 18 by the electromagnetic effect after the electrical conduction, such that the arc-striking spring plates 15 and the transmission spring plates 16 are driven to move towards the fixed arc-striking contacts 13 and the fixed transmission contacts 11. Now, before each of the movable transmission contacts 12 and each of the fixed transmission contacts 11 are opened or closed, each of the movable arc-striking contacts 14 and each of the respective fixed arc-striking contacts 13 are situated in a mutually contacted state to form an electrical conduction, and thus the electric arc generated at the moment of conducting the circuit can be extinguished, and a stable electrical path can be formed when the movable transmission contacts 12 and the respective fixed transmission contacts 11 are moved into a closed state, and different switch sets A are provided for controlling different load circuits. When the electromagnetic structure is not situated in an electrical conduction state and the magnetic force disappears, the armature assembly 18 loses the magnetic force to disconnect the movable transmission contacts 12 and the fixed transmission contacts 11. Before the movable transmission contacts 12 and the respective fixed transmission contacts 11 are disconnected, the movable arc-striking contacts 14 and the respective fixed arc-striking contacts 13 are situated in a mutually contacted state. At the moment when the movable transmission contacts 12 and the fixed transmission contacts 11 are disconnected from one another, the movable arc-striking contacts 14 and the fixed arc-striking contacts 13 are still contacted with one another to maintain the electrical conduction status. Therefore, no electric arc will be generated at the moment when the movable transmission contacts 12 and the fixed transmission contacts 11 are disconnected, and then the electric arc generated when the movable arc-striking contacts 14 and the fixed arc-striking contacts 13 are separated can be extinguished by the movable arc-striking contacts 14 which are smaller than the movable transmission contacts 12.

Figure 6:
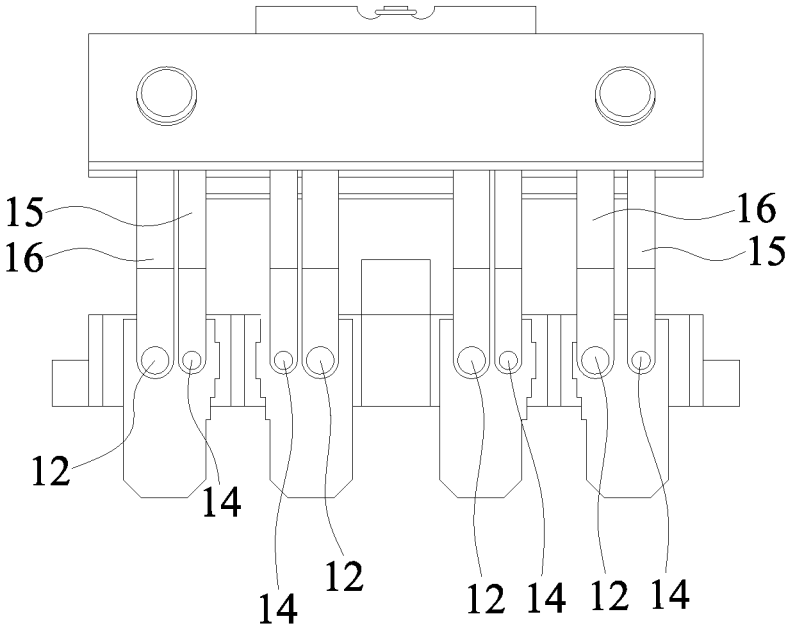
FIG. 6 is a schematic planar view showing another implementation mode of the second embodiment of the present invention.

With reference to FIG. 6 for a schematic planar view of another implementation mode of the second embodiment of the present invention, the relay 1 may comprise a plurality of arc-striking spring plates 15 and a plurality of transmission spring plates 16, so that when the arc-striking spring plates 15 are clamped between two transmission spring plates 16, the arc-striking spring plates 15 and the transmission spring plates 16 are configured to be parallel to one another. Similarly, this structure can extinguish the generated electric arc or spark effectively to prevent short circuits or explosions, so as to meet the arc-striking and arc extinction requirements. Preferably, this configuration may further set the spacing between the arc-striking spring plates 15 to be greater than the spacing between the adjacent arc-striking spring plate 15 and transmission spring plate 16 to prevent a too-near distance that may give rise to an explosion easily. The description of the remaining detailed technical characteristics is the same as above and thus will not be repeated.

In addition, when the arc-striking spring plate 15 and/or the transmission spring plate 16 come with a plural quantity, the transmission spring plates 16 and the arc-striking spring plates 15 are staggered, and the arc-striking spring plates and the transmission spring plates are configured to be parallel to one another. In other words, the arc-striking spring plate 15 may come with a plural quantity, and the transmission spring plate 16 may come with a singular quantity, so that the transmission spring plate 16 clamped between the arc-striking spring plates 15 is in a staggered state; or the transmission spring plate 16 comes with a plural quantity and the arc-striking spring plate 15 comes with a singular quantity, so that the arc-striking spring plate 15 clamped between the transmission spring plates 16 is in a staggered state; or both of the arc-striking spring plate 15 and the transmission spring plate 16 come with a plural quantity, and arranged in a staggered state. Therefore, the relay 1 can extinguish the electric arc or spark effectively during its operation.

With reference to FIGS. 5A~5B for the operation of the relay 1, the transmission spring plate 16 and the arc-striking spring plate 15 are moved with respect to the fixed transmission contact 11 and the fixed arc-striking contact 13 to cope with the electrical conduction state of the electromagnet 10, and the difference resides on the arrangement or configuration of the arc-striking spring plates 15 and the transmission spring plates 16.

In summation of the description above, the high-voltage large-current relay 1 of the present invention provides a structure of the movable arc-striking contact 14 which is smaller than the movable transmission contact 12, so that a sufficient arc extinction effect can be provided in the limited space of the relay 1 and the stability of extinguishing the electric arc can be improved to provide a better arc extinction effect and reduce the volume of the relay. Particularly, the energy of the electric arc generated in an application of high voltage and large current is much greater than the general situation, the movable arc-striking contact 14 with the aforementioned technical characteristic cab stably extinguish the electric arc and overcome the drawbacks of damaging the relay by electric arc or causing accidents such as explosions. The invention can extend the service life of the relay 1 effectively and also improve performance and safety of use of the relay to meet different requirements. As disclosed in the aforementioned embodiments and implantation modes, the configuration of the relay 1 may be changed to provide a better arc-striking effect.

What is claimed is:

1. A high-voltage large-current relay, comprising an electromagnet, at least one fixed transmission contact, at least one movable transmission contact, at least one fixed arc-striking contact, and at least one movable arc-striking contact, and the at least one fixed transmission contact and the at least one movable transmission contact being configured to be corresponsive to each other, and the at least one fixed arc-striking contact and the at least one movable arc-striking contact being configured to be corresponsive to each other, characterized in that the relay further comprises at least one arc-striking spring plate and at least one transmission spring plate, and the at least one movable transmission contact is disposed on the at least one transmission spring plate, and the at least one movable arc-striking contact is disposed on the at least one arc-striking spring plate; wherein the at least one movable arc-striking contact is smaller than the at least one movable transmission contact, and the at least one arc-striking spring plate and the at least one transmission spring plate are operated together, and the at least one movable arc-striking contact and the at least one fixed arc-striking contact are in a mutually contacted state before the at least one movable transmission contact and the at least one fixed transmission contact are driven into an open or closed state by an electromagnetic effect of the electromagnet.

2. The relay of claim 1, wherein the at least one arc-striking spring plate has a width smaller than the at least one transmission spring plate.

3. The relay of claim 2, wherein the at least one arc-striking spring plate and the at least one transmission spring plate are configured to be adjacent to each other and transversely parallel to each other.

4. The relay of claim 2, wherein if the at least one arc-striking spring plate and the at least one transmission spring plate come with a plural quantity, the at least one transmission spring plates are clamped between any two of the at least one arc-striking spring plates, and the at least one arc-striking spring plates and the at least one transmission spring plates are configured to be transversely parallel to one another.

5. The relay of claim 4, wherein the at least one transmission spring plates clamped between two of the at least one arc-striking spring plates are of the same conductive loop to form a switch set.

6. The relay of claim 4, wherein the at least one transmission spring plates clamped between two arc-striking spring plates have a spacing greater than a spacing of the adjacent arc-striking spring plates and transmission spring plates.

7. The relay of claim 5, further comprising at least one spacer, and if the switch set comes with a plural quantity, the spacers are disposed between the adjacent switch sets.

8. The relay of claim 2, wherein if the at least one arc-striking spring plate and/or the at least one transmission spring plate come with a plural quantity, the at least one transmission spring plates and the at least one arc-striking spring plates are configured to be staggered with one another, and the at least one arc-striking spring plates and the at least one transmission spring plates are configured to be transversely parallel to one another.

9. The relay of claim 2, wherein if the at least one arc-striking spring plate and the at least one transmission spring plate come with a plural quantity, the at least one arc-striking spring plates are clamped between two of the at least one transmission spring plates, and the at least one arc-striking spring plates and the at least one transmission spring plates are configured to be transversely parallel to one another.

10. The relay of claim 1, wherein the at least one arc-striking spring plate has an inclined portion, and the at least one movable arc-striking contact is disposed on the inclined portion, and the inclined portion is tilted in a direction towards the at least one fixed arc-striking contact.

11. The relay of claim 2, wherein the at least one arc-striking spring plate has an inclined portion, and the at least one movable arc-striking contact is disposed on the inclined portion, and the inclined portion is tilted in a direction towards the at least one fixed arc-striking contact.

12. The relay of claim 3, wherein the at least one arc-striking spring plate has an inclined portion, and the at least one movable arc-striking contact is disposed on the inclined portion, and the inclined portion is tilted in a direction towards the at least one fixed arc-striking contact.

13. The relay of claim 4, wherein the at least one arc-striking spring plate has an inclined portion, and the at least one movable arc-striking contact is disposed on the inclined portion, and the inclined portion is tilted in a direction towards the at least one fixed arc-striking contact.

14. The relay of claim 5, wherein the at least one arc-striking spring plate has an inclined portion, and the at least one movable arc-striking contact is disposed on the inclined portion, and the inclined portion is tilted in a direction towards the at least one fixed arc-striking contact.

15. The relay of claim 6, wherein the at least one arc-striking spring plate has an inclined portion, and the at least one movable arc-striking contact is disposed on the inclined portion, and the inclined portion is tilted in a direction towards the at least one fixed arc-striking contact.

16. The relay of claim 7, wherein the at least one arc-striking spring plate has an inclined portion, and the at least one movable arc-striking contact is disposed on the inclined portion, and the inclined portion is tilted in a direction towards the at least one fixed arc-striking contact.

17. The relay of claim 8, wherein the at least one arc-striking spring plate has an inclined portion, and the at least one movable arc-striking contact is disposed on the inclined portion, and the inclined portion is tilted in a direction towards the at least one fixed arc-striking contact.

18. The relay of claim 9, wherein the at least one arc-striking spring plate has an inclined portion, and the at least one movable arc-striking contact is disposed on the inclined portion, and the inclined portion is tilted in a direction towards the at least one fixed arc-striking contact.

* * * * *